US006966847B2

(12) United States Patent
Lenhof et al.

(10) Patent No.: US 6,966,847 B2
(45) Date of Patent: Nov. 22, 2005

(54) GOLF CLUB

(75) Inventors: Konrad Lenhof, Vista, CA (US); Jerry V. Blanke, Murrieta, CA (US)

(73) Assignee: Callaway Golf Company, Carlsbad, CA (US)

( * ) Notice: Subject to any disclaimer, the term of this patent is extended or adjusted under 35 U.S.C. 154(b) by 23 days.

(21) Appl. No.: 10/709,600

(22) Filed: May 17, 2004

(65) Prior Publication Data

US 2005/0101405 A1 May 12, 2005

Related U.S. Application Data

(60) Provisional application No. 60/519,501, filed on Nov. 12, 2003.

(51) Int. Cl.[7] ..... A63B 53/02

(52) U.S. Cl. ..... 473/305; 473/307; 473/313; 473/309

(58) Field of Search ..... 473/305–315; 403/24, 200, 299, 300, 309–313, 359.1

(56) References Cited

U.S. PATENT DOCUMENTS

| | | | | | |
|---|---|---|---|---|---|
| 1,665,811 | A * | 4/1928 | Hadden | 473/306 |
| 1,958,032 | A * | 5/1934 | Cocke | 473/306 |
| 1,976,323 | A * | 10/1934 | Buhrke et al. | 473/312 |
| 1,994,149 | A * | 3/1935 | Root | 473/306 |
| 2,076,340 | A * | 4/1937 | Hadden | 473/306 |
| 4,679,791 | A | 7/1987 | Hull | |
| 4,869,304 | A | 9/1989 | Gore | |
| 4,943,059 | A * | 7/1990 | Morell | 473/306 |
| 5,197,733 | A | 3/1993 | Schroder | |
| 5,240,252 | A | 8/1993 | Schmidt et al. | |
| 5,275,399 | A | 1/1994 | Schmidt et al. | |
| 5,326,099 | A | 7/1994 | Yamamoto et al. | |
| 5,362,048 | A | 11/1994 | Haste | |
| 5,540,435 | A * | 7/1996 | Kawasaki | 473/309 |
| 5,722,901 | A * | 3/1998 | Barron et al. | 473/305 |
| 5,741,394 | A | 4/1998 | Kennedy | |
| 5,771,552 | A | 6/1998 | Karner et al. | |
| 5,931,742 | A | 8/1999 | Nishimura et al. | |
| 5,951,411 | A | 9/1999 | Wood et al. | |
| 5,972,144 | A | 10/1999 | Hsu | |
| 6,039,659 | A | 3/2000 | Hamm | |
| 6,050,903 | A | 4/2000 | Lake | |
| 6,089,991 | A | 7/2000 | Yeh | |
| 6,120,384 | A | 9/2000 | Drake | |
| 6,146,286 | A | 11/2000 | Masuda | |
| 6,168,534 | B1 * | 1/2001 | Schultz | 473/299 |
| 6,620,053 | B2 * | 9/2003 | Tseng | 473/297 |
| 6,652,388 | B1 * | 11/2003 | Lenhof et al. | 473/306 |
| 6,769,996 | B2 * | 8/2004 | Tseng | 473/306 |
| 2003/0083144 | A1 * | 5/2003 | Shin | 473/296 |
| 2003/0153398 | A1 * | 8/2003 | Tseng | 473/306 |

* cited by examiner

*Primary Examiner*—Sebastiano Passaniti
(74) *Attorney, Agent, or Firm*—Michael A. Catania; Elaine H. Lo

(57) ABSTRACT

The golf club (20) of the present invention includes a shaft (22), a club head (24) and an attachment assembly (30), which allows for an essentially adhesive free connection between the shaft (22) and the club head (24). In one embodiment, the attachment assembly (30) includes a screw (34) and a shaft ring (32). The shaft ring (32) is welded to the interior wall (40) of the shaft (22) near the tip end (41). Another embodiment of the attachment assembly (30) includes a locking sleeve (50).

7 Claims, 10 Drawing Sheets

GOLF CLUB

CROSS REFERENCE TO RELATED APPLICATIONS

This application claim priority to U.S. Provisional Application No. 60/519,501, filed on Nov. 12, 2003.

FEDERAL RESEARCH STATEMENT

Not Applicable

BACKGROUND OF INVENTION

1. Field of the Invention

The present invention relates to a golf club. More specifically, the present invention relates to an assembly for securing a shaft to a golf club head without the use of an adhesive.

2. Description of the Related Art

The game of golf has benefited greatly from technological advancements throughout its glorious history. Examples include the progression of golf ball from a leather featherie version to the gutta percha version to the dimpled version to the two-piece and three piece versions of today. Another example of the technological advancement of golf is the progression of the shaft from wood to metal to graphite to the hybrid versions of today. Yet another example of the technological advancement of golf is the progression of woods from persimmon to steel to titanium to the advanced materials of today. All of these advancements have greatly improved the game of golf for golfers everywhere. However, the game of golf is still requires a shaft connected to a golf club head in order to strike a golf ball.

The attachment of the shaft to the golf club head requires securing the shaft to the golf club head in a manner that withstands the tremendous forces exerted during swinging and impact with a golf ball.

One preferred manner for attaching a shaft to a metal wood has been the use of an epoxy to secure the shaft within a hosel. This attachment procedure is usually performed manually, with an operator overcoating a tip end of a shaft with epoxy, and then inserting the shaft into the hosel wherein excess epoxy (2 to 4 grams) is flushed onto the golf club head. In a through-bore golf club head, the tip end of the shaft extends through the bore in the sole of the golf club head and is cut during the assembly process. This attachment procedure is wasteful and detrimental to the operator if performed continuously throughout the day. Further, such an attachment procedure typically requires heating the golf club in an oven for two hours to cure the epoxy for securing the shaft to the golf club head. Such ovens require great amounts of floor space in a factory, and use excessive amounts of energy. Thus, there is a need for an improvement in the attachment of a shaft to a golf club head.

SUMMARY OF INVENTION

The present invention provides a golf club that eliminates the need for an adhesive or epoxy to secure a shaft to a golf club head, which reduces production time while making the procedure easier for an operator.

One aspect of the present invention is a golf club that includes a shaft, club head and attachment assembly. The shaft has a wall defining a hollow interior, a tip end and a butt end. The shaft has a notch at the tip end. The club head has a body with a hosel extending outward at a heel end. The hosel has a threaded bore accessible through an opening, and a protuberance extending outward from an exterior surface of the hosel. The protuberance mates with the notch of the shaft. The attachment assembly connects the shaft to the club head, and includes a locking sleeve and a screw. The locking sleeve engages an exterior surface of the tip end of the shaft and an exterior surface of the hosel. The locking sleeve has a body with a wall defining an aperture extending from a first opening to a second opening. The body has a slot in the wall extending from the first opening to the second opening. The body is tapered in diameter from the first opening to the second opening. The screw is placed within the hollow interior of the shaft and threadingly connected to the threaded bore of the hosel of the club head. The attachment assembly provides for an essentially adhesive free attachment of the shaft to the club head.

Another aspect of the present invention is a golf club with an attachment assembly that includes a shaft ring secured within a hollow interior of the tip end of a shaft, and a screw placed within the hollow interior of the shaft, through a bore in the shaft ring and threadingly connected to a hosel of a club head.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
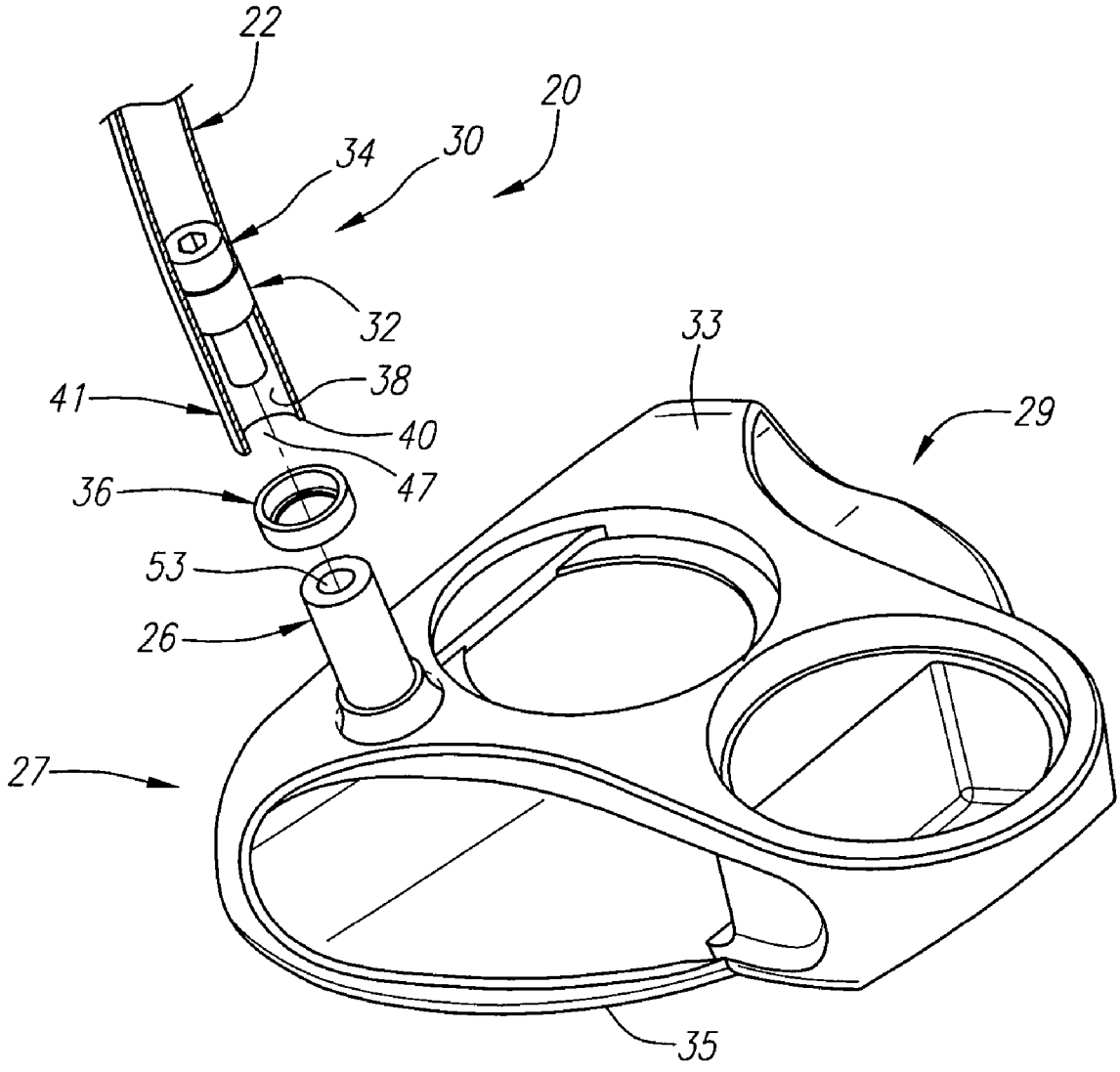
FIG. 1 is an exploded perspective view of a preferred embodiment of a golf club of the present invention.
Figure 2:
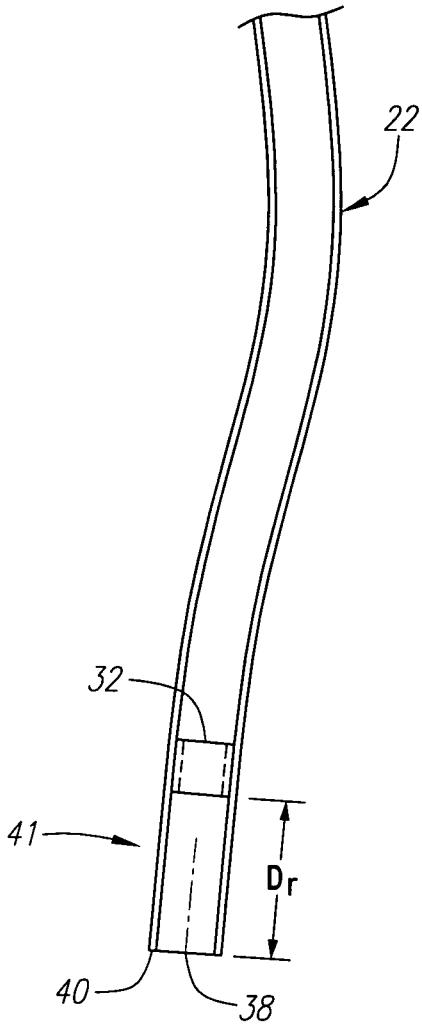
FIG. 2 is an isolated view of a shaft illustrating the interior and placement of a shaft ring within the shaft.
Figure 3:
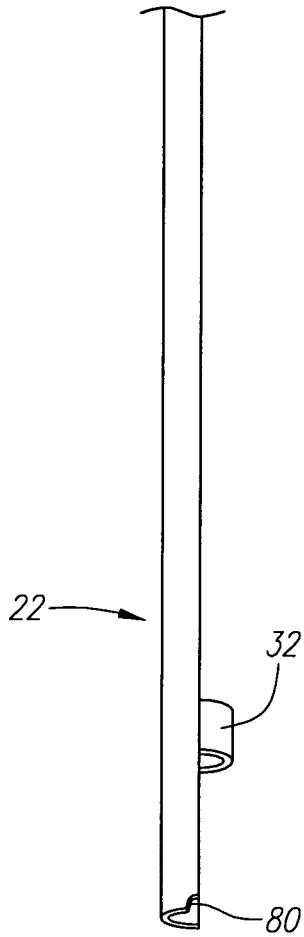
FIG. 3 is an isolated cut-away view of the interior of a shaft to illustrate placement of a shaft ring within the shaft
Figure 4:
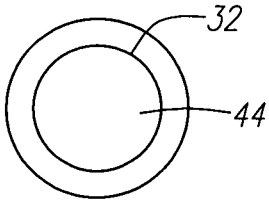
FIG. 4 is an isolated top plan view of the shaft ring.
Figure 5:
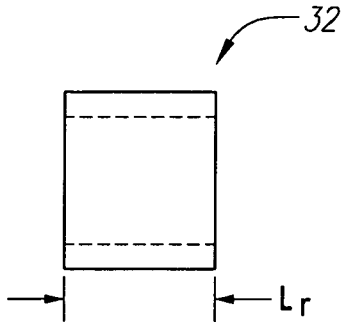
FIG. 5 is an isolated side view of the shaft ring.
Figure 6:
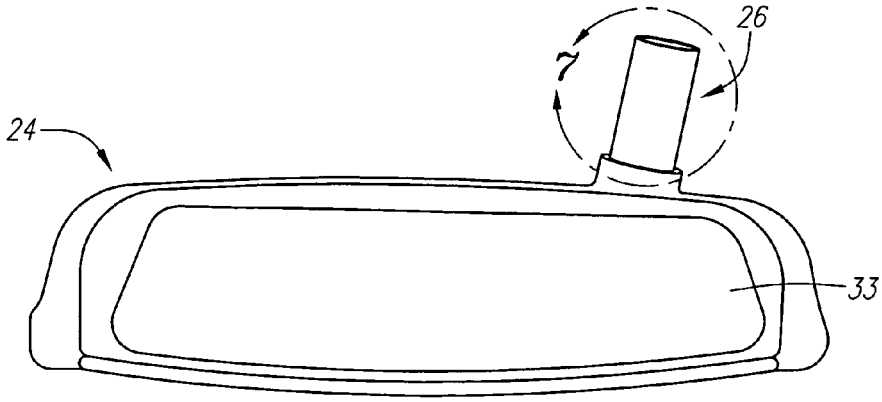
FIG. 6 is a front plan view of a putter-type golf club head of FIG. 1.
Figure 7:
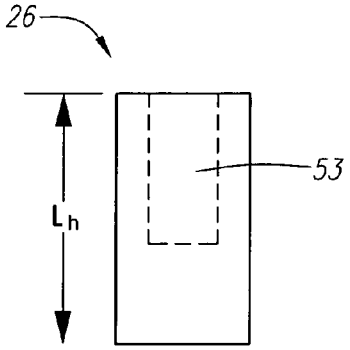
FIG. 7 is an isolated view of the hosel of the putter-type golf club head of FIG. 6.
Figure 8:
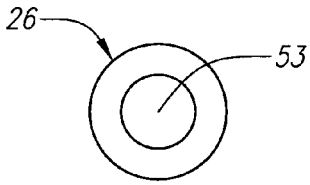
FIG. 8 is a top plan view of the hosel of FIG. 7.
Figure 9:
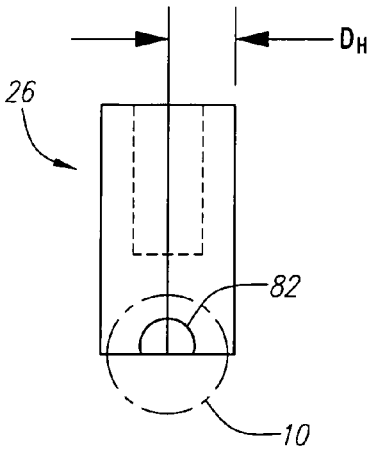
FIG. 9 is an isolated side view of the hosel of FIG. 7.
Figure 10:
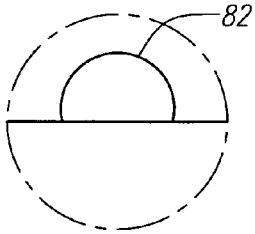
FIG. 10 is an isolated view of circle 10 of FIG. 9.

A golf club of the present invention is generally designated 20. The primary components of the golf club 20 are a shaft 22, a golf club head 24 with a hosel 26 and an attachment assembly 30. The attachment assembly 30 secures the shaft to the hosel 26 of the golf club head 24 with a minimum amount of adhesive or preferably without any adhesive material. In a preferred embodiment, the golf club is a putter. Preferably the shaft 22 is composed of a metal material such as stainless steel, a titanium alloy, or a like metal material.

A preferred embodiment of the golf club 20 is illustrated in FIG. 1. The shaft 22 has a tip end 41 and a butt end 43, not shown. At the tip end 41 is an opening 47 to the hollow interior 38 of the shaft 22. A shaft wall 40 defines the hollow interior 38. In a preferred embodiment, the diameter of the shaft 22 tapers from the butt end 43 to the tip end 41, with the tip end 41 of the shaft 22 having a smaller diameter than the butt end 43. A typical shaft diameter at the tip end is approximately 0.335 inch. Preferably the shaft 22 has a notch 80 at the opening 47. Typically, the shaft 22 has a length of thirty to forty inches, with longer length shafts available for unconventional golf clubs such as "belly putters."

The golf club head 24 preferably has a body 25 with a face 31, a crown 33 and a sole 35. A putter-type golf club head is disclosed in U.S. Pat. No. 6,471,600, entitled Putter Head, which is hereby incorporated by reference in its entirety. The hosel 26 is positioned at a heel end 27 of the club head 24 with a toe end 29 opposite the heel end 27. The hosel 26 is generally defined as a means for connecting the shaft 22 to the club head 24. A preferred hosel 26 is a cylindrical extension extending outward from the crown 33 of the body 25. Other hosels include interior hosels, which are generally cylindrical tubes within a club head. In the embodiment shown in FIGS. 1 and 6–10, the hosel 26 extends outward from the crown 33 a length, Lh, of preferably between 0.5 inch and 1.5 inches, and most preferably 0.625 inch. The hosel 26 preferably has an opening 49 and a threaded bore 53. The hosel 26 preferably has a diameter, Rh, ranging from 0.15 inch to 0.20 inch, and most preferably has a diameter, Rh, of 0.171 inch. A protuberance 82 is preferably located on an exterior surface 56 of the hosel 26 to engage the notch 80 of the shaft 22. The notch 80/protuberance 82 engagement provides an alignment mechanism for the shaft 22 and provides an initial engagement of the shaft 22 to the club head 24 prior to a final connection by the attachment assembly 30.

In the preferred embodiment, the attachment assembly 30 is composed of a shaft ring 32 which is secured to the wall 40 of the shaft 22, and a screw 34. As shown in FIGS. 2–5, the shaft ring 32 is preferably welded to the wall 40 of the shaft 22, preferably a distance, Dr, from the opening 47 ranging from 0.25 inch to 2.5 inches, and most preferably 0.750 inches from the opening 47 at the tip end 41 of the shaft 22. The screw ring 32 is preferably composed of a metal material similar to the shaft 22 such as stainless steel or a titanium alloy. The screw ring preferably has a length, Lr, ranging from 0.1 inch to 1.0 inch, and most preferably a length of 0.250 inch. The screw ring preferably has a diameter of approximately 0.310 inch. The shaft ring 32 has a bore 44 with a diameter of preferably 0.218 inch. The bore 44 is preferably threaded. The screw 34 is preferably a 10–32×⅝ screw and has a screw head 46 and a screw body threaded body 48. The screw 34 secures the shaft 22 to the club head 24 through threadingly engaging the threaded bore 53 of the hosel 26. The screw 34 is placed through the butt end 43 of the shaft, through the bore 44 in the shaft ring 32 and into the threaded bore 53. A screwdriver, not shown, is placed through the interior 38 of the shaft from the butt end 43 to turn the screw 34 to threadingly engage the threaded bore 53 of the hosel 26 thereby securing the shaft 22 to the club head 24 without the need of an adhesive. The screwdriver is then removed and a grip, not shown, is placed on the butt end 43 of the shaft 22.

FIGS. 11–14 illustrate an alternative embodiment of the golf club of the present invention. This embodiment is similar to the embodiment of FIG. 1. However, the attachment assembly 30 includes a locking sleeve 50 to secure the shaft 22 to the club head 24. Further, a washer 97 is used in place of the shaft ring 32. The screw 34 is threaded into the threaded bore 53 of the hosel 26. The locking sleeve 50 is placed within the hollow interior 38 of the shaft 22 to engage with the interior surface 45 of the wall 40 of the shaft 22.

Figure 18:
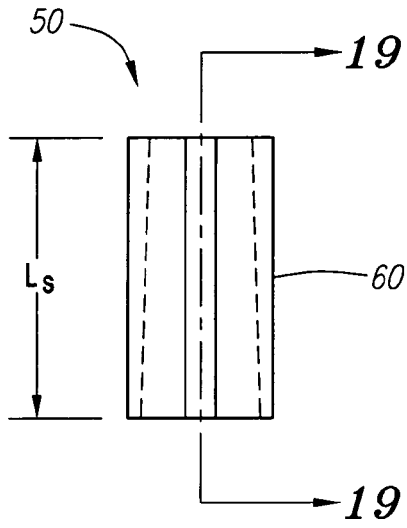
FIG. 18 is an isolated view of the sleeve of the golf club of FIG. 15.
Figure 19:
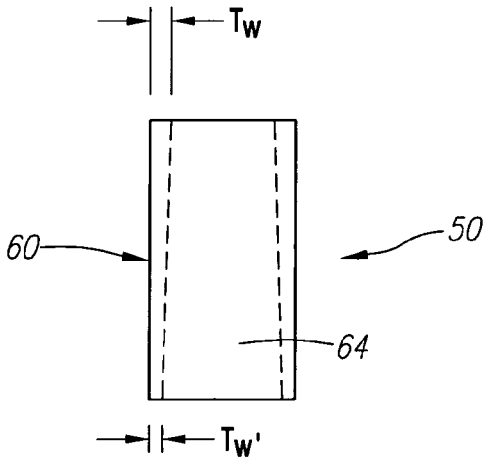
FIG. 19 is a cross-sectional view of the sleeve of FIG. 18.
Figure 20:
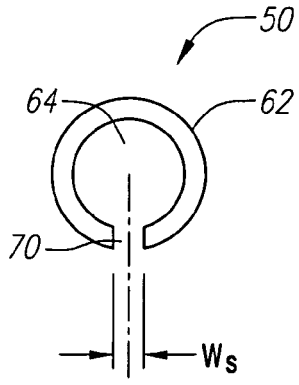
FIG. 20 is a top plan view of the sleeve FIG. 18.
Figure 21:
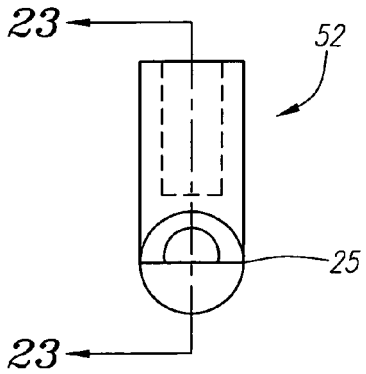
FIG. 21 is an isolated view of the stub of the hosel of the golf club of FIG. 15.
Figure 22:
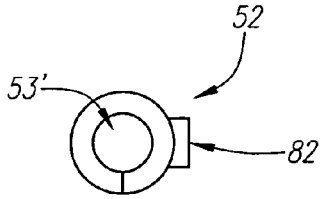
FIG. 22 is a top plan view of the stub of FIG. 21.
Figure 23:
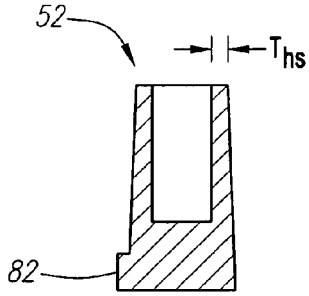
FIG. 23 is a cross-sectional view of the stub of FIG. 21 along lines 23—23.
Figure 24:
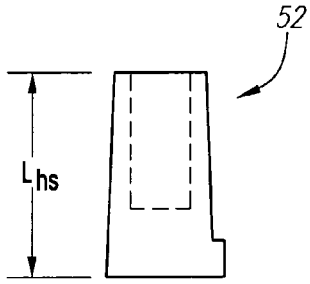
FIG. 24 is a side of the stub of FIG. 21.
Figure 25:
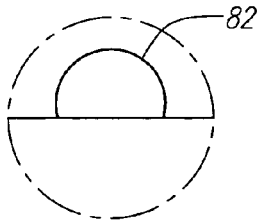
FIG. 25 is an isolated view of circle 25 of FIG. 21.

As shown in FIGS. 18–20, the locking sleeve 50 has a body 60 with a wall 62. The locking sleeve 50 is preferably composed of a metal material, most preferably an aluminum material. The body 60 has an aperture 64 extending between a first opening 66 and a second opening 68. The body 60 also has at least a first slot 70 in the wall 62 extending from the first opening 66 to the second opening 68. The locking sleeve 50 preferably has a length, Ls, which ranges from 0.25 inch to 2.0 inches, and is most preferably 0.6 inch in length. The locking sleeve 50 preferably has an outer diameter ranging from 0.250 inch to 0.5 inch, and is most preferably 0.324 inch. Further, the locking sleeve 50 preferably tapers from the first opening 66 to the second opening from 1 to 4 degrees, and most preferably 1.5 degrees. The thickness of the wall 62 nearest the first opening 66 is preferably thicker than the thickness of the wall 62 nearest the second opening 68. In a preferred embodiment, the thickness of the wall 62 near the first opening 66 is twice as thick as the thickness of the wall 62 near the second opening 68. In a most preferred embodiment, the thickness of the wall 62 near the first opening 66, $T_w$, is 0.044 inch in thickness, and the thickness of the wall 62 near the second opening 68, $T_{w'}$, is 0.027 inch. The first slot 70 preferably has a width ranging from 0.030 inch to 1.5 inches, and is most preferably 0.076 inch. The first slot 70 allows for the contraction and extension of the locking sleeve 50.

In this embodiment, the locking sleeve 50 expands or contracts to tightly engage the interior surface 45 of the shaft 22 and the exterior surface 56 of the hosel 26. The screw 34 and washer 97 prevent the vertical or lengthwise movement of the locking sleeve 50.

Figure 15:
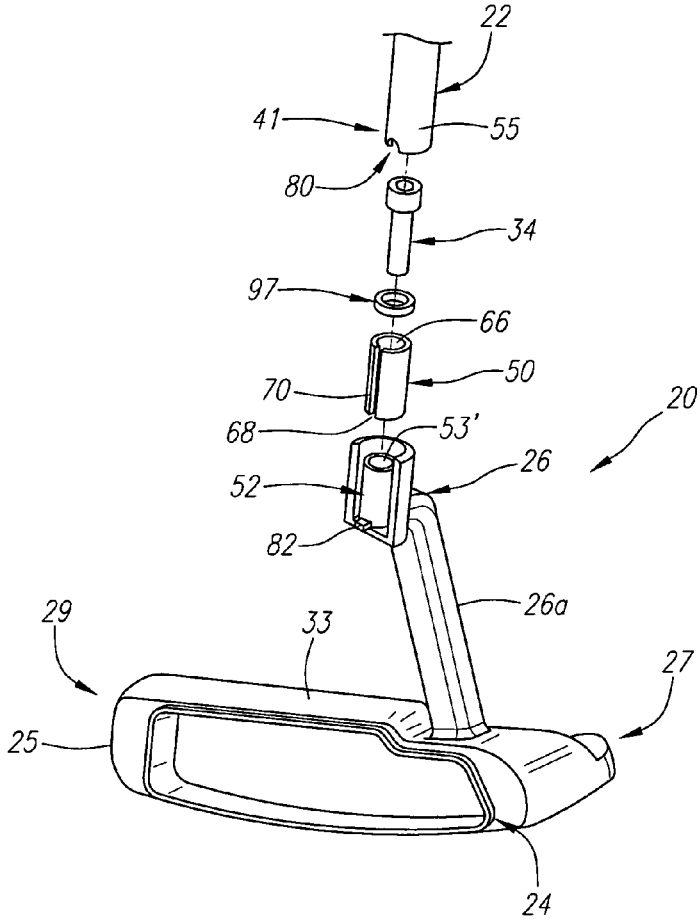
FIG. 15 is an exploded perspective view of an alternative embodiment of a golf club of the present invention.

FIG. 15 illustrates yet another embodiment of the golf club 20 of the present invention. In this embodiment, the hosel 26 includes a hosel extension arm 26*a*, which extends the hosel 26 upward and positions the attachment of the shaft 22 to the club head 24 above the surface of the crown 33. In this embodiment, the hosel 26 has an opening 49, a hollow interior 51, a hosel stud 52 with a threaded bore 53', and a protuberance 82 on the exterior surface of the hosel stud 52.

As shown in FIGS. 21–25, the hosel stud 52 preferably has a length, $L_{hs}$, ranging from 0.25 inch to 1.0 inch, and most preferably 0.560 inch. The hosel stud 52 preferably has a diameter ranging from 0.150 inch to 0.5 inch, and most preferably 0.259 inch. The hosel stud 52 preferably has a taper of from 1–3 degrees and most preferably 1.5 degrees from a top to a bottom of the hosel stud 52.

Figure 16:
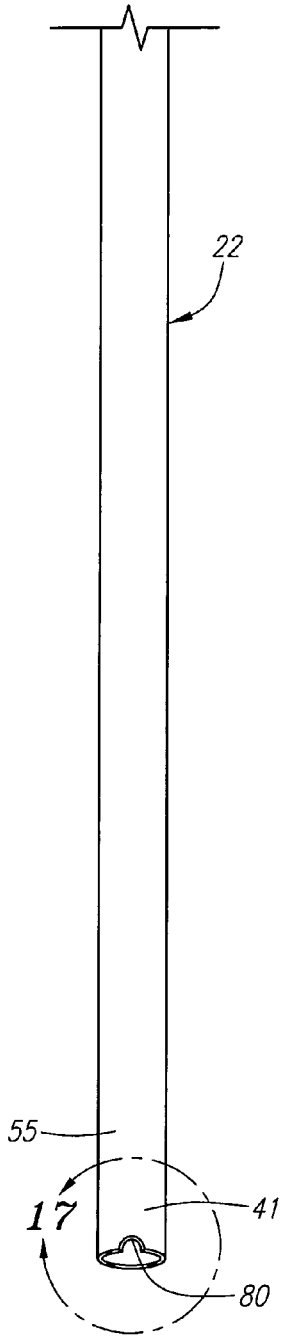
FIG. 16 is an isolated view of the shaft of the golf club of FIG. 15.
Figure 17:
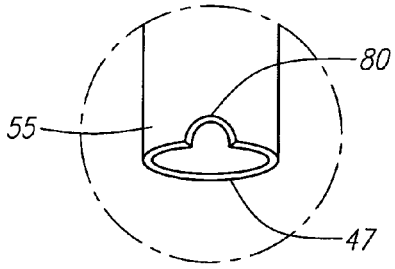
FIG. 17 is an isolated view of circle 17 of FIG. 14.

As shown in FIGS. 16–17, the shaft 22 preferably has a notch 80 at the opening 47. In this embodiment, the notch engages with the protuberance 82 on the exterior surface of the stud 52 to prevent the rotational movement of the shaft 22 within the hollow interior 51 of the hosel 26.

Figure 11:
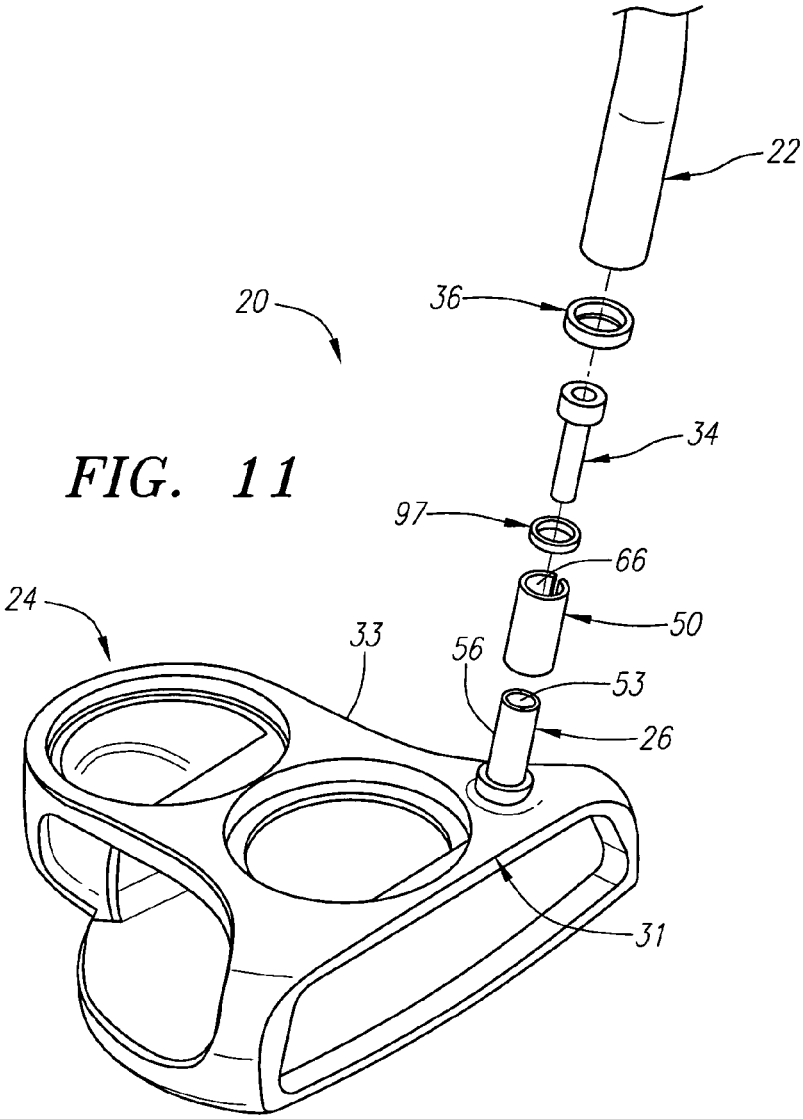
FIG. 11 is an exploded perspective view of an alternative embodiment of a golf club of the present invention.
Figure 12:
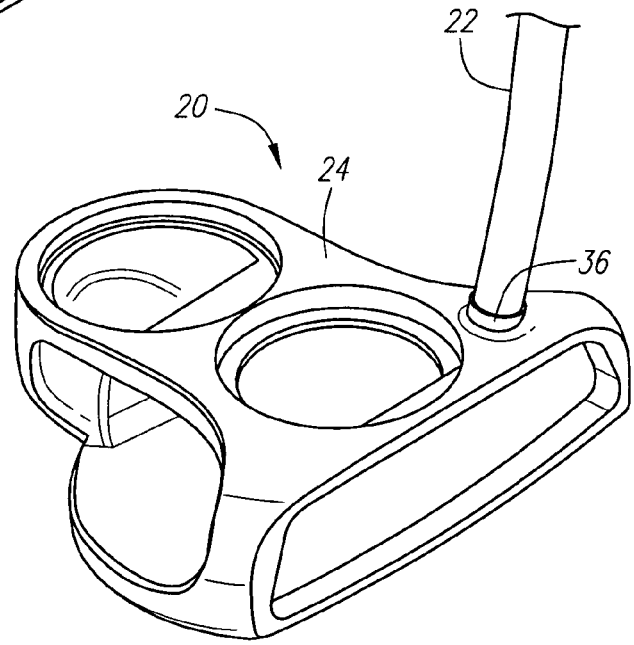
FIG. 12 is a perspective view of the assembled golf club of FIG. 11.
Figure 13:
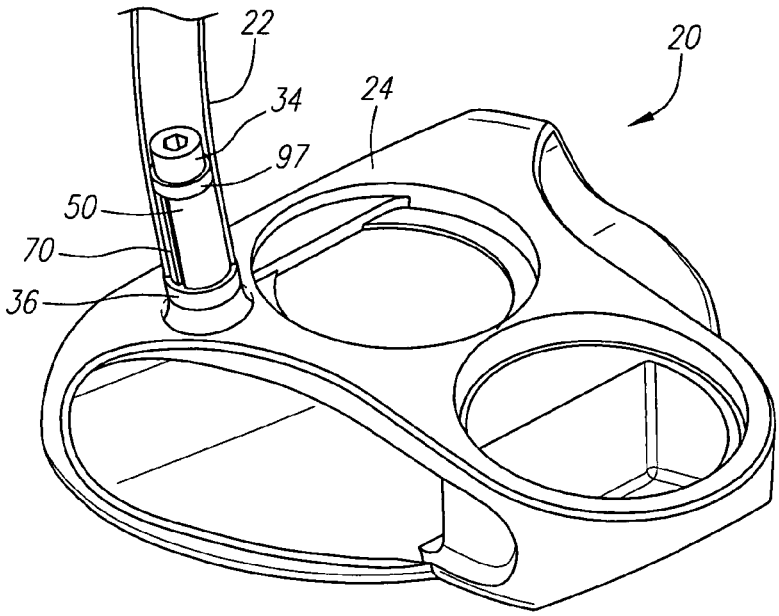
FIG. 13 is a perspective view of the assembled golf club of FIG. 11 illustrating the attachment assembly.
Figure 14:
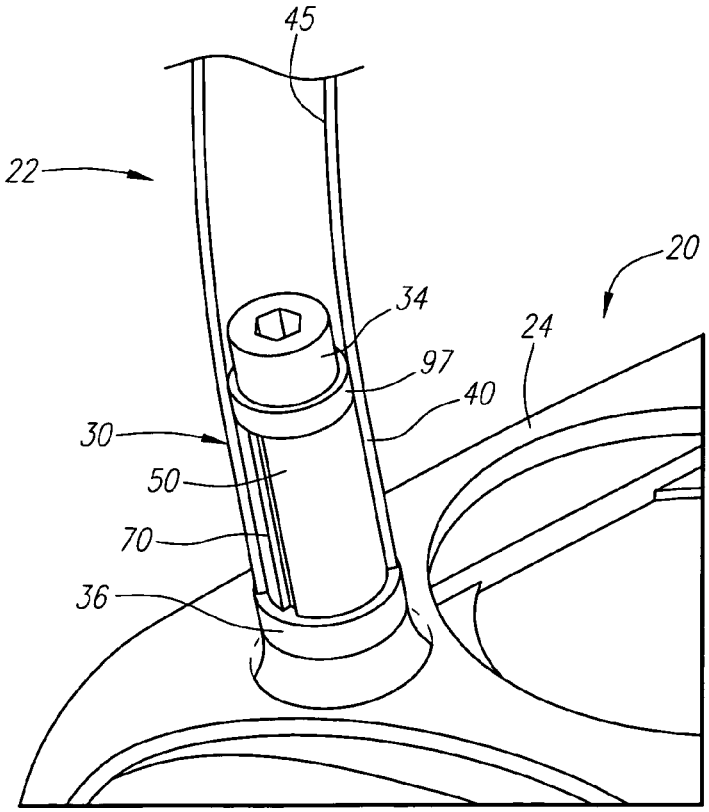
FIG. 14 is an isolated view of attachment assembly shown in FIG. 13.

Similar to the embodiment of FIG. 11, the attachment assembly 30 includes the locking sleeve 50, the screw 34 and the washer 97. The screw 34 is threaded into the threaded bore 53' of the hosel stud 52. The locking sleeve 50 engages the exterior surface of the hosel stud 52 and the interior surface 45 of the shaft 22. The exterior surface 55 of the shaft 22 engages the interior surface 57 of the hosel 26. This embodiment also utilizes a screwdriver, not shown, which is placed through the interior 38 of the shaft from the butt end 43 to turn the screw 34 to threadingly engage the threaded bore 53' of the hosel stud 52 to prevent movement of the locking sleeve 50 which engages the exterior surface of the hosel stud 52 and the interior surface 45 of the shaft 22 thereby securing the shaft 22 to the club head 24 without the need of an adhesive.

Figure 26:
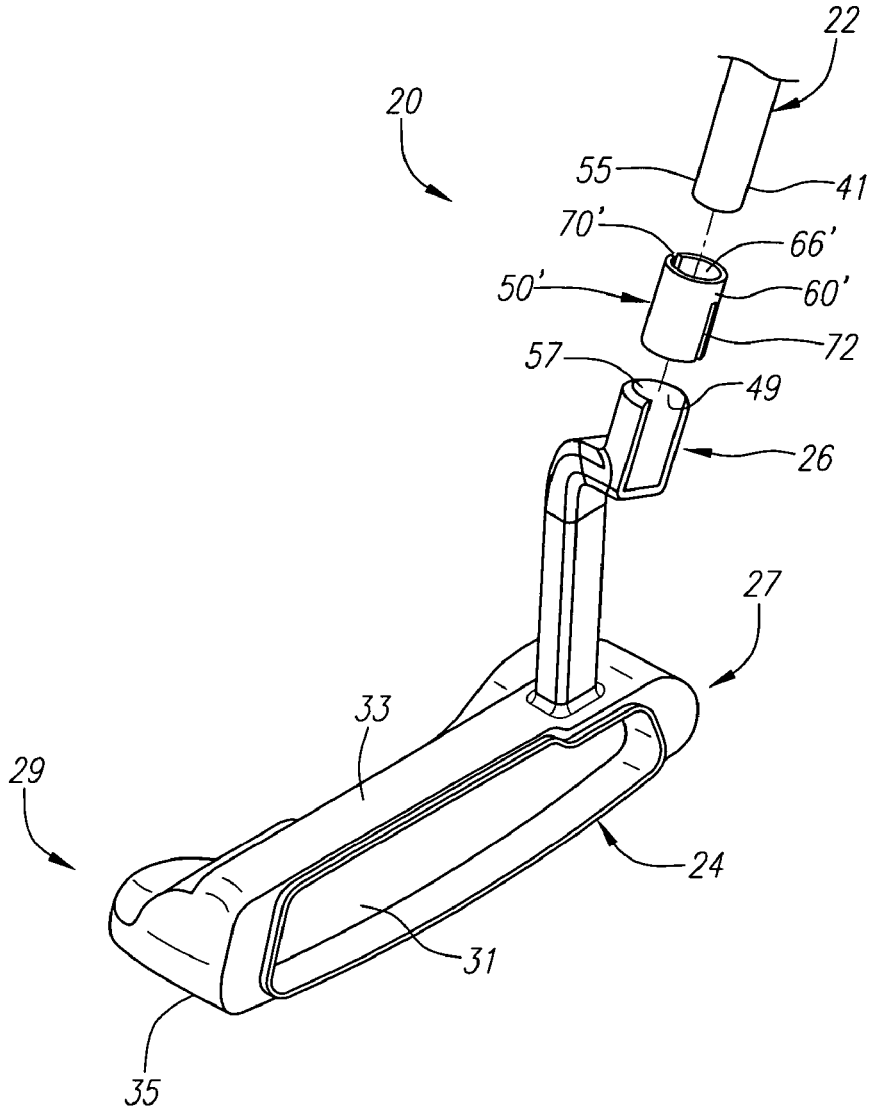
FIG. 26 is an exploded perspective view of an alternative embodiment of a golf club of the present invention.
Figure 27:
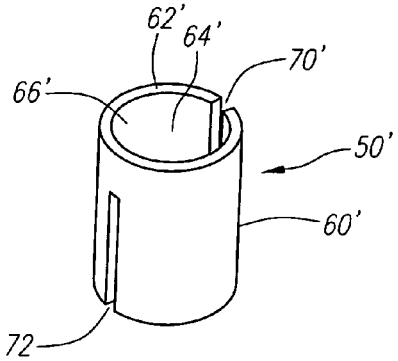
FIG. 27 is an isolated view of the sleeve of the golf club of FIG. 26.
Figure 28:
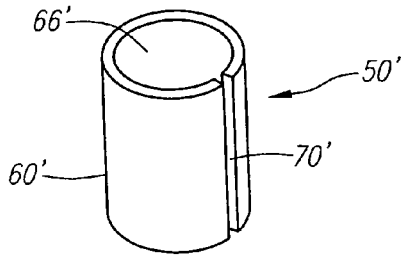
FIG. 28 is a perspective view of the sleeve of FIG. 27.
Figure 29:
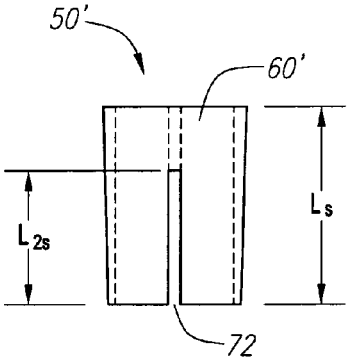
FIG. 29 is a plan side view of the sleeve of FIG. 27.
Figure 30:
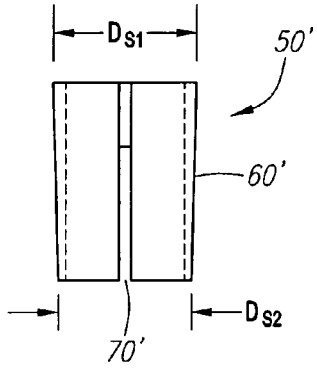
FIG. 30 is a plan side view of the sleeve of FIG. 27.
Figure 31:
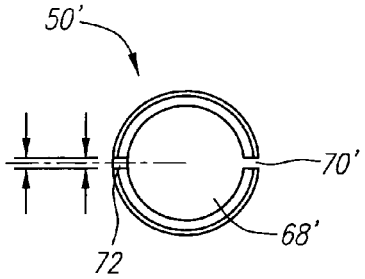
FIG. 31 is a bottom plan view of the sleeve FIG. 18.

FIG. 26 illustrates yet another embodiment in which the attachment assembly 30 is the locking sleeve 50'. In this embodiment, the locking sleeve 50' engages the exterior surface 55 of the shaft 22 and the interior surface 57 of the hosel 26 thereby securing the shaft 22 to the club head 24 without the use of an adhesive.

As shown in FIGS. 27–31, the locking sleeve 50' has a body 60' with a wall 62'. The locking sleeve 50' is preferably composed of a metal material, most preferably an aluminum material. The body 60' has an aperture 64' extending between a first opening 66' and a second opening 68'. The body 60' also has at least a first slot 70' in the wall 62' extending from the first opening 66' to the second opening 68'. The body 60' also has a second slot 72 in the wall 62' which extends from the second opening 68' but ends prior to the first opening 66', and the length $L_{2s}$, is preferably between 25% to 90% of the length of the locking sleeve 50', and most preferably 66% of the length of the locking sleeve 50'. The locking sleeve 50' preferably has a length, $L_s$, which ranges from 0.25 inch to 2.0 inches, and is most preferably 0.6 inch in length. The locking sleeve 50' preferably has a first diameter, $D_{s1}$, ranging from 0.250 inch to 0.75 inch, and is most preferably 0.438 inch. The locking sleeve 50' preferably has a second diameter, $D_{s2}$, ranging from 0.200 inch to 0.70 inch, and is most preferably 0.407 inch. Further, the locking sleeve 50' preferably tapers from the first opening 66' to the second opening 68' from 1 to 5 degrees, and most preferably 3 degrees. The first slot 70' preferably has a width ranging from 0.020 inch to 1.5 inches, and is most preferably 0.034 inch. The second slot 72 preferably has a similar width as the first slot 70'. The first and second slots 70' and 72 allow for the contraction and extension of the locking sleeve 50'.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club comprising:

a shaft having a wall defining a hollow interior, the shaft having a tip end and a butt end;

a club head having a body with a heel end and a toe end, the body having a hosel extending outward, the hosel located at the heel end, the hosel having an open end and a hollow interior;

locking sleeve for securing the tip end of the shaft to the hosel, the locking sleeve engaging an exterior surface of the tip end of the shaft and an interior surface of the hosel, the locking sleeve having a body with a wall defining an aperture extending from a first opening to a second opening, the body having a first slot in the wan extending from the first opening to the second opening and the body having a second slot in the wall extending from the second opening along the wall and ending prior to the first opening, the body tapered in diameter from the first opening to the second opening.

2. The golf club according to claim 1 wherein the locking sleeve has a length from the first opening to the second opening ranging from 0.3 inch to 1.0 inch, and the body has a taper of three degrees.

3. The golf club according to claim 1 wherein the second slot of the body of the locking sleeve has a length ranging from 0.2 inch to 0.75 inch.

4. A golf club comprising:

a shaft having a wall defining a hollow interior, the shaft having a tip end and a butt end, the shaft having a notch at the tip end;

a club head having a body with a heel end and a toe end, the body having a hosel extending outward, the hosel located at the heel end, the hosel having a threaded bore accessible through an opening, the hosel having a protuberance extending outward from an exterior surface of the hosel, the protuberance mating with the notch of the shaft; and an attachment assembly connecting the shaft to the club head, the attachment assembly comprising a locking sleeve for securing the shaft to the hosel, the locking sleeve engaging an exterior surface of the tip end of the shaft and an exterior surface of the hosel, the locking sleeve having a body with a wall defining an aperture extending from a first opening to a second opening, the body having a slot in the wall extending from the first opening to the second opening, the body tapered in diameter from the first opening to the second opening, and a screw placed within the hollow interior of the shaft and threadingly connected to the threaded bore of the hosel of the club head.

5. The golf club according to claim 4 further comprising a washer positioned around a portion of a threaded body of the screw.

6. The golf club according to claim 4 further comprising a ferrule encircling a portion of an exterior surface of the tip end of the shaft.

7. A golf club comprising:

a shaft having a wall defining a hollow interior, the shaft having a tip end and a butt end, the shaft having a notch at the tip end;

a club head having a body with a heel end and a toe end, the body having a hosel extending outward, the hosel located at the heel end, the hosel having a threaded bore accessible through an opening, the hosel having a protuberance extending outward from an exterior surface of the hosel, the protuberance mating with the notch of the shaft; and an attachment assembly connecting the shaft to the club head, the attachment assembly comprising a locking sleeve for securing the shaft to the hosel, the locking sleeve composed of a metal material, the locking sleeve engaging an exterior surface of the tip end of the shaft and an exterior surface of the hosel, the locking sleeve having a body with a wall defining an aperture extending from a first opening to a second opening, the body having a slot in the wall extending from the first opening to the second opening, the body tapered in diameter from the first opening to the second opening, and a screw placed within the hollow interior of the shaft and threadingly connected to the threaded bore of the hosel of the club head;

whereby the attachment assembly provides for an essentially adhesive free attachment of the shaft to the club head.

* * * * *